US005183633A

United States Patent [19]

Thierry et al.

[11] Patent Number: 5,183,633

[45] Date of Patent: Feb. 2, 1993

[54] STEEL HAVING IMPROVED WELDABILITY AND METHOD THEREOF

[75] Inventors: Maurickx Thierry, Dunkerque; Verrier Pascal, Lumbres; Taillard Roland, Villeneuve D'Asco, all of France

[73] Assignee: Sollac, Puteaux, France

[21] Appl. No.: 773,434

[22] Filed: Oct. 9, 1991

[30] Foreign Application Priority Data

Oct. 18, 1990 [FR] France ..... 90 12916

[51] Int. Cl.[5] ..... C22C 38/12

[52] U.S. Cl. ..... 420/92; 148/654; 148/332

[58] Field of Search ..... 148/12 F, 12.4, 332, 148/336, 654; 420/92, 93, 126

[56] References Cited

U.S. PATENT DOCUMENTS 3,832,166 8/1974 Okada et al. ..... 420/93

FOREIGN PATENT DOCUMENTS 0080809 6/1983 European Pat. Off. .
2239092 2/1974 Fed. Rep. of Germany .
2436419 2/1975 Fed. Rep. of Germany .
2517164 10/1976 Fed. Rep. of Germany .
2212434 7/1974 France .
2500482 8/1982 France .
60-89550 5/1985 Japan ..... 420/92

*Primary Examiner*—Deborah Yee
*Attorney, Agent, or Firm*—Oblon, Spivak, McClelland, Maier & Neustadt

[57] ABSTRACT

The present invention relates to a steel having improved weldability exhibiting good cracking resistance for high welding energies, good low-temperature toughness and requiring no preheating before welding.

The composition by weight of the steel is the following:

0.07 to 0.11% carbon,
1.40 to 1.70% manganese,
0.20 to 0.55% nickel,
0 to 0.30% copper,
0 to 0.02% niobium,
0.005 to 0.020% titanium,
0.002 to 0.006% nitrogen,
0 to 0.15% silicon, the balance being iron.

4 Claims, 2 Drawing Sheets

STEEL HAVING IMPROVED WELDABILITY AND METHOD THEREOF

The present invention relates to a structural steel having improved weldability.

The use of steel in harsh environments such as steels for naval application which are used on ships, LNG tankers or ice breakers for example, sailing in the North Sea or the Arctic Ocean, and oil-drilling platforms or steels used for liquified gas storage containers, demands that very restricted specifications be respected.

Beyond their tensile properties, the grades of steels for welded constructions must satisfy a high level of low-temperature brittle fracture strength, this temperature being a function of the stress conditions and of the service temperature of the structure.

It is known to use a steel referenced 355 EMZ in the European classification and whose composition by weight is the following:

0.11% carbon,
1.45% manganese,
0.45% nickel,
0.40% silicon,
0.05% niobium,
0.05% nitrogen, the balance being iron.

The mechanical properties guaranteed by such a steel for a sheet of 50 mm thickness are the following yield stress Re min=340 MPa.
load at fracture Rm min=460 MPa.
elongation ($5.65\sqrt{S}$) A=20%.
toughness at −40° C. Kv=50 J (minimum value).
CTOD at −10° C.=0.25 mm.

The CTOD (Crack Tip Opening Displacement) corresponds to a standard fracture test (standard BS 5762).

Figure 1:
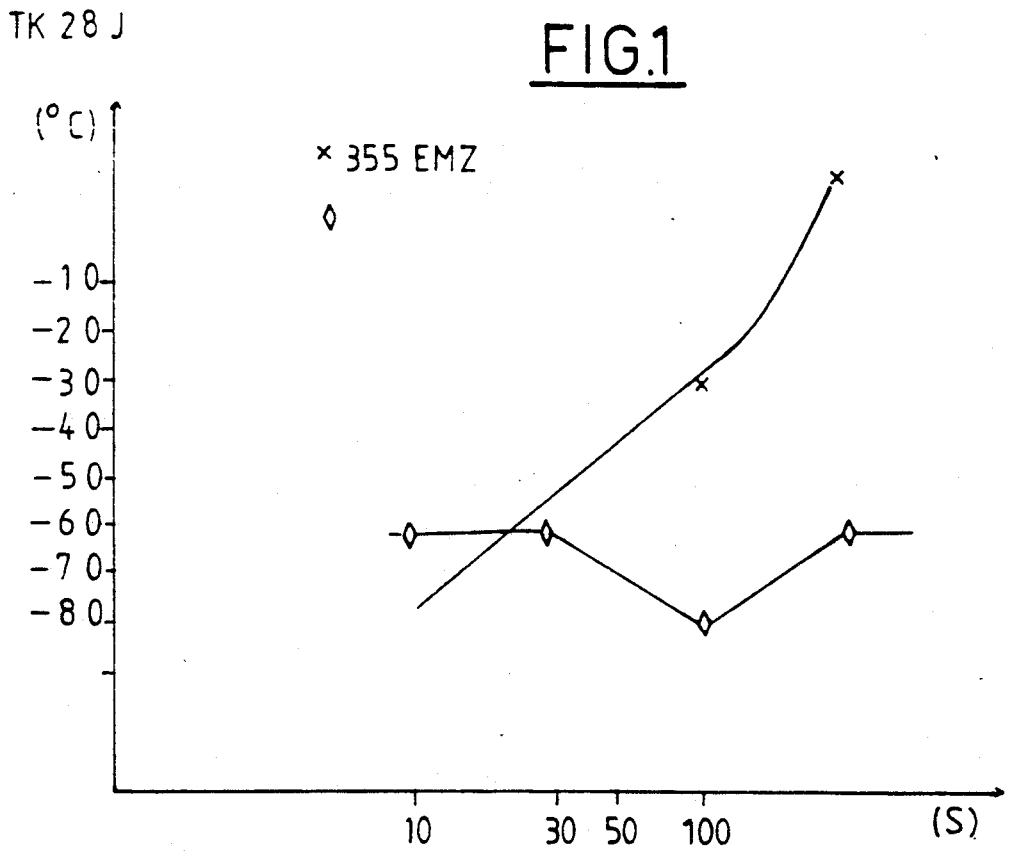

FIG. 1 shows the transition temperature for a toughness energy of 28 Joules as a function of the cooling time from 700° to 300° C. for a steel of the 355 EMZ type.

It is observed that in order to have a fracture energy greater than 28 J at −40° C., it is necessary to weld with a cooling rate from 700° C. to 300° C. less than 50 s. It is essential therefore to weld slowly, which implies that it is necessary to make several passes with a low welding energy.

Figure 2:
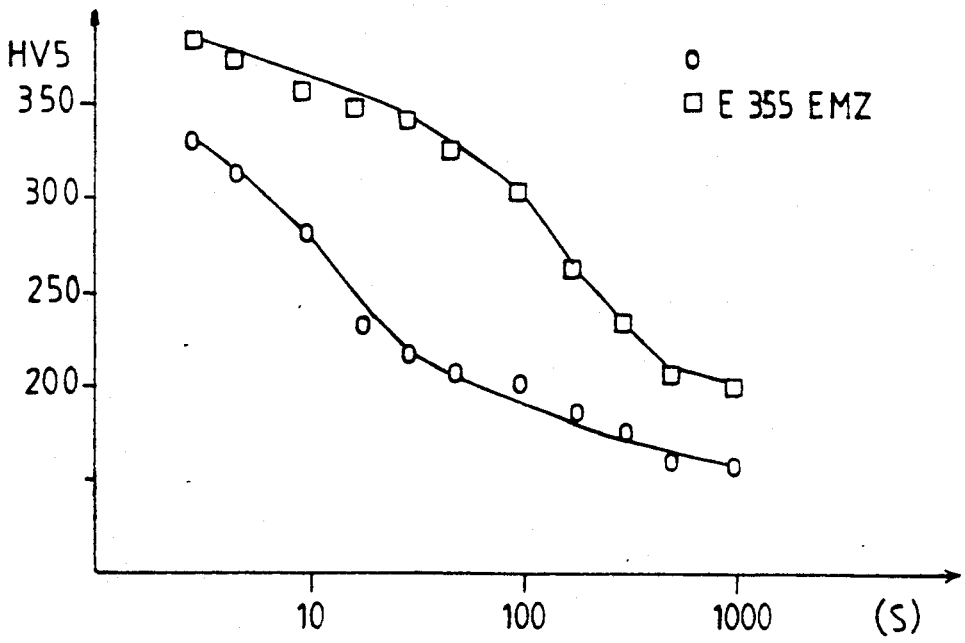

The low-temperature cracking resistance of such a steel may be estimated from the hardness-cooling criterion curve shown in FIG. 2.

It is observed that in the case of a manual welding by electrode, corresponding to a cooling time between 700° and 300° C. of approximately 10 s, the Vickers hardness is greater than 350 HV5. This is explained by the fact that the structure exhibits 80 to 100% martensite.

Now, as martensite is sensitive to hydrogen, such a weld exhibits a poor low-temperature cracking resistance.

Consequently, such a known steel, of the 355 EMZ type, exhibits low toughness for high welding energies and requires a preheating before welding in order to prevent low-temperature cracking.

The subject of the present invention is a steel having improved weldability exhibiting good toughness for high welding energies and requiring no preheating before welding.

The subject of the present invention therefore is a steel having improved weldability, characterised in that it contains silicon in a proportion of less than 0.15% and titanium in a proportion of between 0.005 and 0.020%.

According to another characteristic, the composition by weight of the steel with improved weldability according to the invention is the following:

0.07 to 0.11% carbon,
1.40 to 1.70% manganese,
0.20 to 0.55% nickel,
0 to 0.30% copper,
0 to 0.02% niobium,
0.005 to 0.020% titanium,
0.002 to 0.006% nitrogen,
0 to 0.15% silicon,
the balance being iron.

Preferably, the composition by weight of the steel having improved weldability according to the invention is the following:

0.08% carbon,
1.50% manganese,
0.45% nickel,
0.20% copper,
0.01% titanium,
0.004% nitrogen,
0.09% silicon,
the balance being iron.

Such a steel may be obtained, for example, by:

low-temperature heating between the ferrite-austenite AC3 transformation temperature and 1100° C.,
rolling between 850° and 720° C.,
quenching from 750° to 450 ° at between 3° and 10° per second.

Other characteristics and advantages will appear in the course of the description which will follow, given solely by way of example, with reference to the attached drawings, in which:

FIG. 1 shows the variation of the transition temperature for a fracture energy of 28 Joules (TK 28J) as a function of the cooling rate of the weld for an ordinary 355 EMZ steel and for the steel having improved weldability according to the invention, FIG. 2 shows the hardness-cooling criterion curve for an ordinary 355 EMZ steel and for the steel having improved weldability according to the invention.

Figure 3:
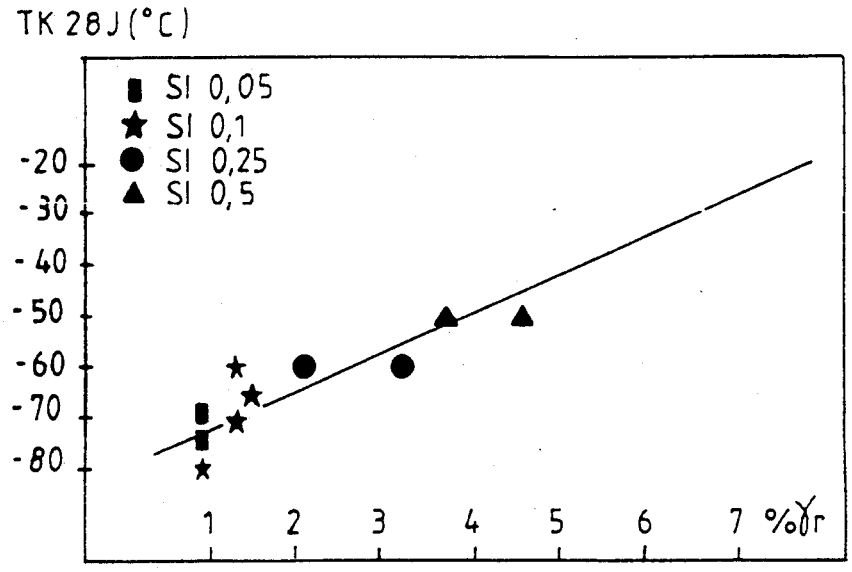
Figure 4:
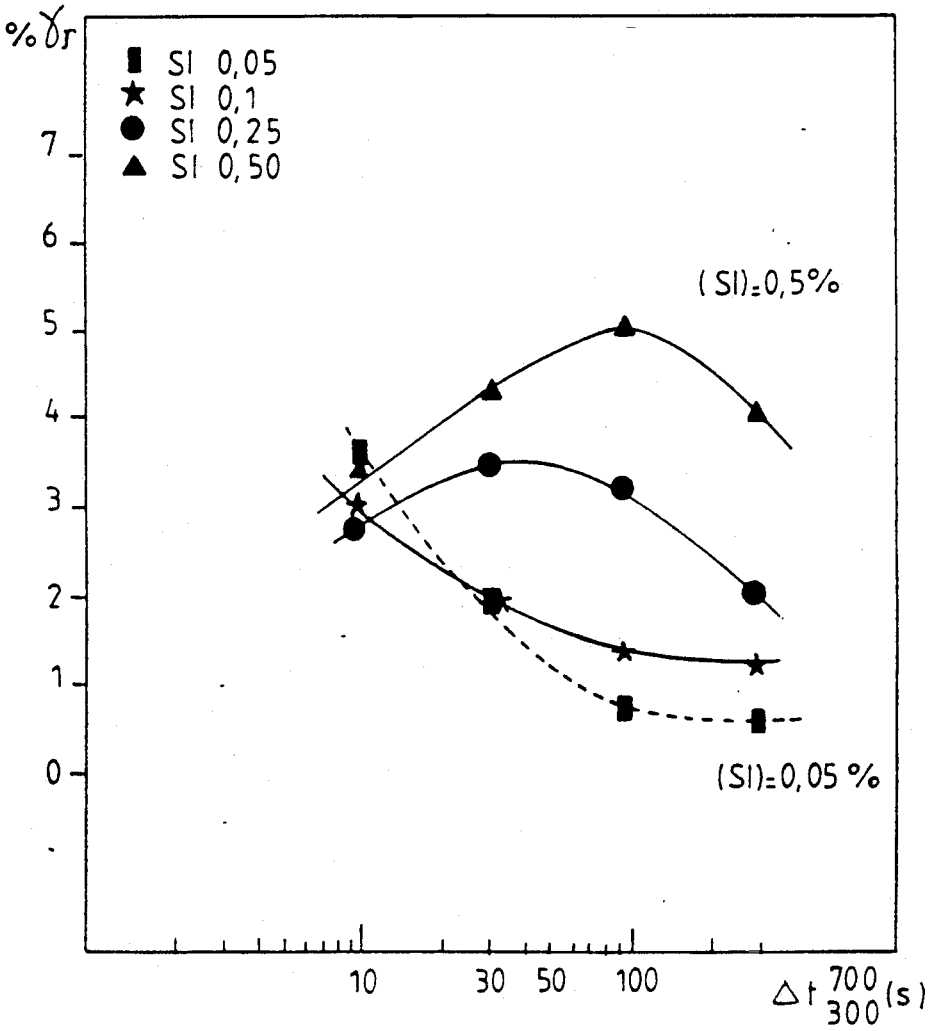

FIG. 3 shows the influence of the silicon content, on the one hand on the transition temperature at 28 Joules (TK 28J) and, on the other hand, on the volume fraction of retained austenite ($\gamma r$), FIG. 4 shows the variation of the volume fraction of retained austenite ($\gamma r$) as a function of the cooling criterion and of the silicon content of the steel.

The composition by weight of the steel having improved weldability according to the invention is:

0.07 to 0.11% carbon,
1.40 to 1.70% manganese,
0.20 to 0.55% nickel,
0 to 0.30% copper,
0 to 0.02% niobium,
0.005 to 0.020% titanium,
0.002 to 0.006% nitrogen,
0 to 0.15% silicon,
the balance being iron.

Preferably, the composition by weight of the steel having improved weldability according to the invention comprises:

0.08% carbon,
1.50% manganese,
0.45% nickel,
0.20% copper, 0.01% titanium,
0.004% nitrogen,
0.09% silicon
the balance being iron.

When the curve of transition temperature at 28 J as a function of the cooling rate for the weld of the ordinary 355 EMZ steel is compared with that of the steel having improved weldability according to the invention (FIG. 1), it is observed that regardless of the welding energy, that is to say regardless of the cooling rate of the weld, toughness of the steel according to the invention is always guaranteed down to −60° C.

Such a steel therefore has good toughness even for high welding energy.

The hardness-cooling criterion curve shown in FIG. 2 indicates that the steel having improved weldability exhibits a hardness less than that of the ordinary 355 EMZ steel.

Indeed, the Vickers hardness for a cooling of the zone affected by the heat from 700° to 300° C. in 10 s is only 280 HV5, against at least 350 HV5 for the ordinary steel.

The steel having improve weldability according to the invention exhibits very little martensite, less than 20%.

Toughness at low temperatures is therefore greatly improved and such a steel does not require preheating before welding.

The steel having improved weldability according to the invention makes it possible to guarantee the following mechanical properties for a sheet of 50 mm thickness:

yield stress Re min=325 MPa.
load at fracture=460 MPa.
elongation (5.65 $\sqrt{S}$) A=22%.
toughness at −60° C. KV=80 J.

CTOD at −50° C.=0.10 mm.

Such a steel therefore makes it possible, either to guarantee the same properties as the ordinary 355 EMZ steel but to weld with higher welding energies or, by keeping the same welding energy, to guarantee the mechanical tenacity properties at a lower service temperature, thus allowing applications in a harsher environment to be envisaged.

As may be seen in FIG. 3, the silicon content has an influence on the transition temperature at 28 Joules (TK 28J) and therefore on the tenacity of the zone affected by the heat.

Indeed, it is observed that for a silicon content of 0.05% the transition temperature at 28 Joules is of the order of −70° C. Whereas, for a silicon content of 0.5%, this temperature, above which an energy necessary for fracture not less than 28 Joules is guaranteed, is only −50° C.

It is also observed in FIGS. 3 and 4 that the fraction of austenite retained in the zone affected by the heat is a function of the silicon content of the steel. This phenomenon is associated with a favoured decomposition from austenite to ferrite and carbides during the cooling after welding.

Thus, in FIG. 4 it is seen that for a silicon content of 0.05% the level of retained austenite with high welding energies is approximately 1% whereas it is 5% for the same energies with a silicon content of 0.5%.

Consequently, the improvement in the tenacity of the welded joint arises from the reduction in the volume fraction of retained austenite which is ensured by the diminution of the silicon content of the steel.

The steel having improved weldability may be obtained, for example, by ladle casting, continuous casting, furnace processing, processing in oxygen steel plant or aluminium killing.

The description hereinbelow relates to an example of a process for obtaining sheets of 50 mm thickness with a steel according to the invention.

The steel having improved weldability according to the invention is obtained by continuous casting of known type while taking the necessary precautions for controlling segregation.

After casting, the steel undergoes a low-temperature heating between the ferrite-austenite AC3 transformation temperature and 1100° C., followed by rolling.

The temperature at the end of rolling is between 850° and 720° C.

The steel then undergoes quenching from the temperature at the end of rolling to 450° C. at a rate of 3° to 10° C. per second.

The steel having improved weldability used for establishing the curves shown in FIGS. 1 and 2 is a steel whose composition is that given preferentially in the description and obtained according to the following process:

homogeneous heating at 950° C. for 3 hours,
rolling between 760° and 740° C.,
cooling to 550° C. at a rate of 6° C. per second.

We claim:

1. Steel having improved weldability, comprising, by weight;

0.07 to 0.11% carbon,
1.40 to 1.70% manganese,
0.20 to 0.55% nickel,
0 to 0.30% copper,
0 to 0.02 niobium,
0.005 to 0.20% titanium,
0.002 to 0.006% nitrogen,
0 to 0.15% silicon,
the balance being iron.

2. Steel according to claim 1, comprising, by weight:

0.08% carbon,
1.50% manganese,
0.45% nickel,
0.20% copper,
0.01% titanium,
0.004% nitrogen,
0.09% silicon,
the balance being iron.

3. Process for obtaining a steel according to one of claim 1 or claim 2, comprising the steps of:

low-temperature heating between the ferrite-austenite AC3 transformation temperature and 1100° C.,
rolling between 850° and 720° C.; and
quenching from 750° to 450° C. at a rate of 3° to 10° per second.

4. Process according to claim 3, wherein:

said heating step is carried out at 950° C. for three hours;
said rolling step is carried out between 760° and 740° C.; and
said cooling step is carried out to 550° C. at a rate of 6° per second.

* * * * *